US010532905B2

(12) United States Patent
Nakayashiki

(10) Patent No.: US 10,532,905 B2
(45) Date of Patent: Jan. 14, 2020

(54) SHEET CONVEYANCE APPARATUS AND IMAGE FORMING APPARATUS

(71) Applicant: CANON KABUSHIKI KAISHA, Tokyo (JP)

(72) Inventor: Yuji Nakayashiki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/800,273

(22) Filed: Nov. 1, 2017

(65) Prior Publication Data

US 2018/0127228 A1 May 10, 2018

(30) Foreign Application Priority Data

Nov. 7, 2016 (JP) ..... 2016-217017

(51) Int. Cl.

| | |
|---|---|
| ***B65H 29/60*** | (2006.01) |
| ***B65H 1/04*** | (2006.01) |
| ***B65H 3/06*** | (2006.01) |
| ***B65H 5/06*** | (2006.01) |

(52) U.S. Cl.

CPC ..... *B65H 29/60* (2013.01); *B65H 1/04* (2013.01); *B65H 3/06* (2013.01); *B65H 5/062* (2013.01); *B65H 2801/06* (2013.01)

(58) Field of Classification Search

CPC . B65H 29/60; B65H 1/04; B65H 3/06; B65H 5/062

USPC ..... 399/107, 110, 124, 125

See application file for complete search history.

(56) References Cited

U.S. PATENT DOCUMENTS 8,371,582 B2 * 2/2013 Matsuno ..... B41J 11/006 271/184

2006/0083547 A1 * 4/2006 Otaka ..... B65H 5/062 399/124

FOREIGN PATENT DOCUMENTS

JP 3582531 B2 8/2004

JP 2011-063334 A 3/2011

* cited by examiner

*Primary Examiner* — Thomas A Morrison

(74) *Attorney, Agent, or Firm* — Venable LLP

(57) ABSTRACT

A sheet conveyance apparatus includes a body portion, and an openable unit including an openable portion supported by the body portion, a first movable guide to guide a sheet, a supporting portion to movably support the first movable guide between a first position, at which a first conveyance path through which the sheet is conveyed is formed between the first movable guide and the openable portion, and a second position, at which the first conveyance path is opened, the supporting portion being moved away from the body portion along with an opening operation of the openable portion, and a second movable guide movably supported by the first movable guide. An abutment portion abuts with the second movable guide in a state where the openable portion is closed, such that the second movable guide is held on a position to form a second conveyance path through which the sheet is conveyed.

15 Claims, 4 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus that conveys sheets, and an image forming apparatus that includes the sheet conveyance apparatus.

Description of the Related Art

Some image forming apparatuses, such as printers, facsimiles, and copying machines, cause a sheet to pass through an image forming portion while conveying the sheet upward in a substantially vertical direction, and form an image on the front side of the sheet. In a case where images are formed on both sides of a sheet, the apparatuses cause a sheet to pass through the image forming portion, reverse the sheet, convey the sheet downward in the substantially vertical direction, and cause the sheet to pass through the image forming portion again to form an image on the back side of the sheet. In this configuration, a conveyance path through which the sheet is conveyed downward in the substantially vertical direction and a conveyance path through which the sheet is conveyed upward in the substantially vertical direction are connected via a curved conveyance path.

As disclosed in Japanese Patent No. 3582531, there is proposed an image forming apparatus having a reverse conveyance unit that can reverse sheets. In the image forming apparatus, when a sheet is jammed in a conveyance path, an operator opens the reverse conveyance unit for example, and removes the sheet jammed in the conveyance path. In the image forming apparatus, the reverse conveyance unit, which can be opened and closed, is pivotably supported by an apparatus body, and a first guide plate is pivotably supported on a frame of the reverse conveyance unit.

In addition, a second guide plate is pivotably supported on the apparatus body, on an inner side of the image forming apparatus with respect to the first guide plate when the reverse conveyance unit is closed. Between the second guide plate and the apparatus body, there is formed a main path through which a sheet is conveyed upward to an image forming portion. Between the frame of the reverse conveyance unit and the first guide plate, there is formed a reconveyance path through which a sheet is conveyed downward to form an image on the back side of the sheets by re-conveying the sheet.

In the image forming apparatus described in Japanese Patent No. 3582531, the main path is provided in the apparatus body and the reconveyance path is provided in the reverse conveyance unit. In this configuration, however, when a sheet is jammed in a curved conveyance path, and an operator tries to open the reverse conveyance unit, an opening operation of the reverse conveyance unit may be hampered by the jammed sheet, or otherwise the sheet may be torn, lowering maintainability or operability in removing the jammed sheet. In addition to this, there has been desired to ensure positioning accuracy of components defining the conveyance paths in a state where an openable portion such as the reverse conveyance unit is closed, and to ensure appropriate dimensions of the conveyance paths to stably convey the sheets.

SUMMARY OF THE INVENTION

The present invention provides a sheet conveyance apparatus from which a jammed sheet is easily removed and which ensures to accurately position a component defining a conveyance path, and an image forming apparatus including the same.

According to one aspect of the present invention, a sheet conveyance apparatus includes: a body portion; an openable portion supported by the body portion and configured to be opened and closed with respect to the body portion; a first movable guide supported by the openable portion and movable to a first position at which a first conveyance path through which a sheet is conveyed is formed between the first movable guide and the openable portion, and a second position at which the first conveyance path is opened; a second movable guide movably supported by the first movable guide; and an abutment portion provided in the body portion and configured to abut with the second movable guide in a state where the openable portion is closed, such that the second movable guide is held on a position to form a second conveyance path through which the sheet is conveyed.

Further features of the present invention will become apparent from the following description of exemplary embodiments with reference to the attached drawings.

DESCRIPTION OF THE EMBODIMENTS

Figure 1B:
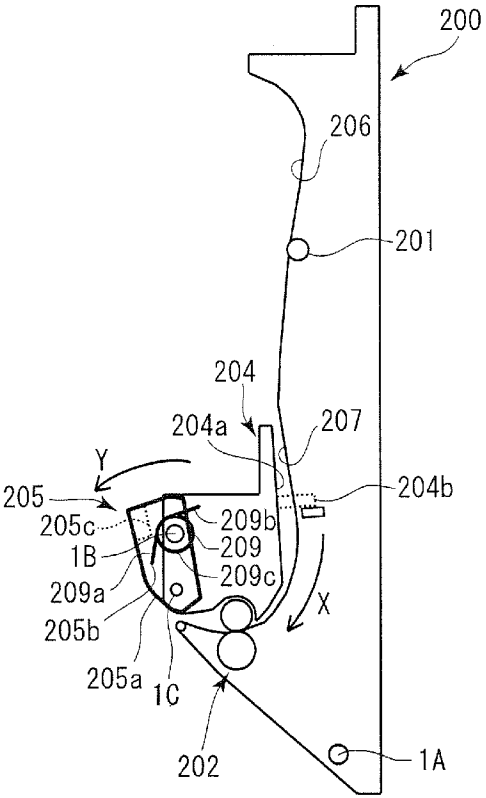
FIG. 1B is a cross-sectional view illustrating a schematic configuration of the door.
Figure 1A:
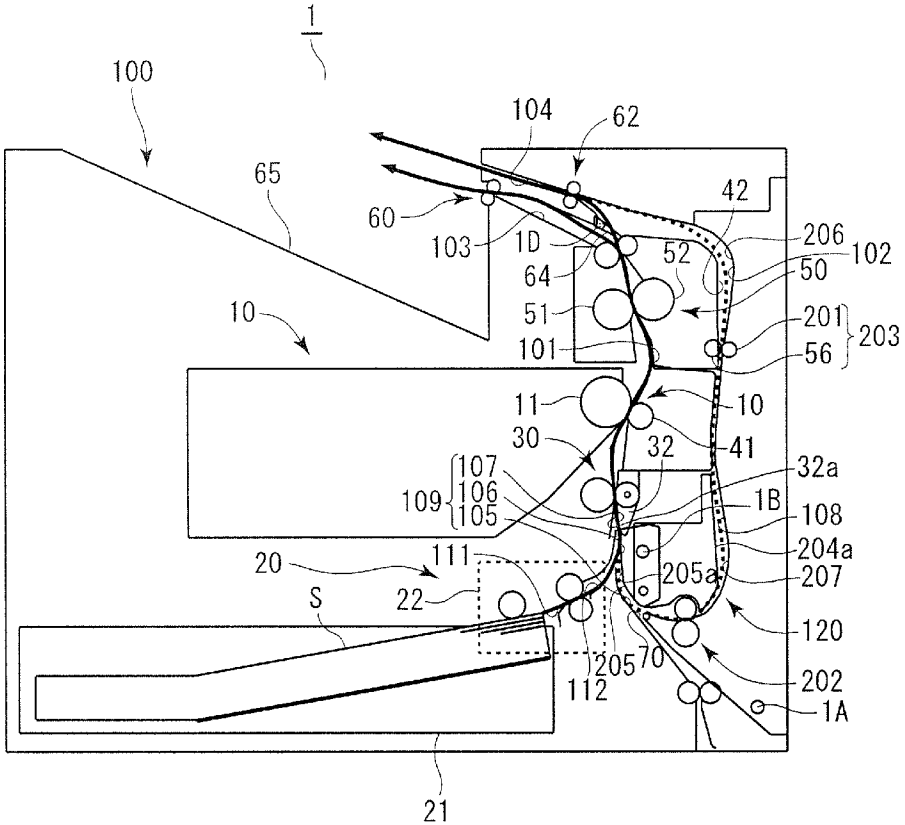
FIG. 1A is a cross-sectional view schematically illustrating an overall configuration of an image forming apparatus of a first embodiment, in which a door is closed.

Hereinafter, a first embodiment will be described. A printer 1, which serves as an image forming apparatus and a sheet conveyance apparatus of the present embodiment, is an electrophotographic laser-beam printer. As illustrated in FIG. 1A, the printer 1 includes a sheet feeding apparatus 20 that feeds a sheet S stacked therewithin, an image forming portion 10 as an example of image forming portion that forms an image on the sheet S, and a fixing portion 50 that fixes the formed image on the sheet S.

When the printer 1 receives an image forming instruction and receives image data from an external device, such as a computer connected to the printer 1, the image forming portion 10 starts an image forming process. A laser scanner (not illustrated) irradiates a photosensitive drum 11, provided in the image forming portion 10, with a laser beam in accordance with the received image data. Irradiated with the laser beam, on the photosensitive drum 11, which is charged in advance by a charging roller (not illustrated), is formed an electrostatic latent image. After that, a developing roller (not illustrated) develops the electrostatic latent image into a toner image on a cylindrical surface of the photosensitive drum 11.

The sheet feeding apparatus 20 includes a feeding cassette 21 on which the sheets S are stacked and which stores the sheets S, a feed-and-separation unit 22 that includes a plurality of rollers, and a feeding path 111 that guides the sheet S conveyed by the feed-and-separation unit 22. Here, the sheet S has a first surface on which an image is formed at first by the image forming portion 10, and a second surface which is opposite to the first surface. The feeding path 111 includes an upper feeding-guide surface 33, illustrated in FIG. 2, which faces the first surface of the sheet S and serves as an opposing guide portion opposed to the second movable guide; and a lower feeding-guide surface 112 which faces the second surface.

In parallel with the above-described image forming process, the feed-and-separation unit 22 separates the sheets S, one by one, from the feeding cassette 21, and conveys the sheets S through the feeding path 111. The feeding path 111 communicates with an upstream passing path 106 located downstream of the feeding path 111. The upstream passing path 106 communicates with a downstream passing path 107 located downstream of the upstream passing path 106. Here, the word "downstream" refers to a downstream side in the conveyance direction of the sheet S, and the word "upstream" refers to an upstream side in the conveyance direction of the sheet S, as is in the following description.

The upstream passing path 106 includes the upper feeding-guide surface 33, and an upstream passing-guide surface 205*a* which is continuous with and provided downstream of the lower feeding-guide surface 112. The downstream passing path 107 includes the upper feeding-guide surface 33, and a downstream passing-guide surface 32*a* which is continuous with and provided downstream of the upstream passing-guide surface 205*a*. The sheet S, conveyed by the feed-and-separation unit 22, passes through the upstream passing path 106 and the downstream passing path 107; and is conveyed to a registration roller pair 30, which serves as a conveyance portion.

The image forming portion 10 is provided downstream of the registration roller pair 30. The registration roller pair 30 and the image forming portion 10 are connected with each other via a main path 101. The registration roller pair 30 forms deflection of the sheet S to correct skew of the sheet S, and rotates to convey the sheet S to the image forming portion 10 through the main path 101 at a predetermined timing. The toner image, formed on the cylindrical surface of the rotating photosensitive drum 11 of the image forming portion 10, is transferred onto the sheet S in the image forming portion 10, by an action of transfer bias applied via a transfer roller 41.

The fixing portion 50 is provided downstream of the image forming portion 10, and includes a heating roller which contains a heater (not illustrated), and a pressure roller 52 which is in pressure contact with the heating roller 51. The sheet S, on which the toner image is transferred, is guided upward in a substantially vertical direction, i.e., the gravity direction, through the main path 101; and heated and pressurized by the heating roller 51 and the pressure roller 52. With this process, the toner image is fixed on the sheet S.

At the downstream end of the main path 101, a discharging flap 64 is provided. The discharging flap 64 swings on a swing shaft D, and changes a conveyance route of the sheet S. In a case where an image is formed on only one side of the sheet S, the sheet S on which the toner image is fixed in the fixing portion 50 is guided to a discharge path 103 by the discharging flap 64, and discharged onto a discharge tray 65 by a rotating discharge roller pair 60.

In a case where images are formed on both sides of the sheet S, the sheet S whose toner image is fixed on the first surface in the fixing portion 50 is guided to an reverse path 104 by the discharging flap 64; and guided to a rotating duplex reverse roller pair 62. A duplex conveyance path 102, which serves as a reconveyance path, extends in parallel with the main path 101, on an outer side with respect to the main path 101. Here, a side which is near the central portion of the printer 1 is referred to as an inner side, and a side which is near the outer surface of the printer 1 is referred to as an outer side, as in the following description. The duplex conveyance path 102 includes a duplex inner guide surface 42, and a duplex outer guide surface 206 which is disposed on an outer side with respect to the duplex inner guide surface 42 and faces the duplex inner guide surface 42.

The duplex reverse roller pair 62 rotates in the opposite direction when the trailing edge of the sheet S reaches a predetermined reverse position, and conveys the sheet S by a switchback conveyance to the opposite direction toward the duplex conveyance path 102. The sheet S, conveyed to the duplex conveyance path 102, is guided downward in the substantially vertical direction through the duplex conveyance path 102, and conveyed further downstream by a rotating duplex roller pair 203 provided on the duplex conveyance path 102. The duplex roller pair 203 includes a rotating duplex inner roller 56, and a duplex outer roller 201 which is adjacent to the duplex inner roller 56 and disposed substantially parallel with the duplex inner roller 56. Here, the phrase "substantially parallel" means that, for example, an angle formed by the main path 101 and a door swing shaft 1A may not necessarily be zero degrees, and may be 0 to 5 degrees. The same holds true for the expression of "substantially parallel" in the following description made for the other portions.

The duplex conveyance path 102 communicates with a first path 108 located downstream of the duplex conveyance path 102. The first path 108, i.e., first conveyance path, is constituted by an outer guide surface 207 which is continuous with the duplex outer guide surface 206, and an inner guide surface 204*a* which is continuous with the duplex inner guide surface 42. The first path 108 communicates with a joining path 105 located downstream of the first path 108. The joining path 105 is constituted by a joining inner guide surface 70 which is continuous with the outer guide surface 207, and an upstream passing-guide surface 205*a* which faces the joining inner guide surface 70. The joining path 105 communicates with the upstream passing path 106 located downstream of the joining path 105. The joining path 105, the upstream passing path 106, and the downstream passing path 107 form a second path 109, i.e., second conveyance path. By the first path 108 and the second path 109, there is formed a curved path 120 which is curved in a substantially U shape, and connects the downstream end of the duplex conveyance path 102 and the upstream end of the main path 101. The feeding path 111 and the curved path 120 join together into the upstream passing path 106.

The sheet S that is conveyed to the first path 108 by the duplex roller pair 203 is conveyed to the registration roller pair 30 again by a refeeding roller pair 202 provided on the curved path 120, through the second path 109. The sheet S that is conveyed by the registration roller pair 30 is conveyed to the image forming portion 10, in which an image is formed on the second surface of the sheet S; then conveyed to the fixing portion 50, in which the image is fixed on the sheet S; and then discharged onto the discharge tray 65 by the discharge roller pair 60, via the discharging flap 64.

Figure 2:
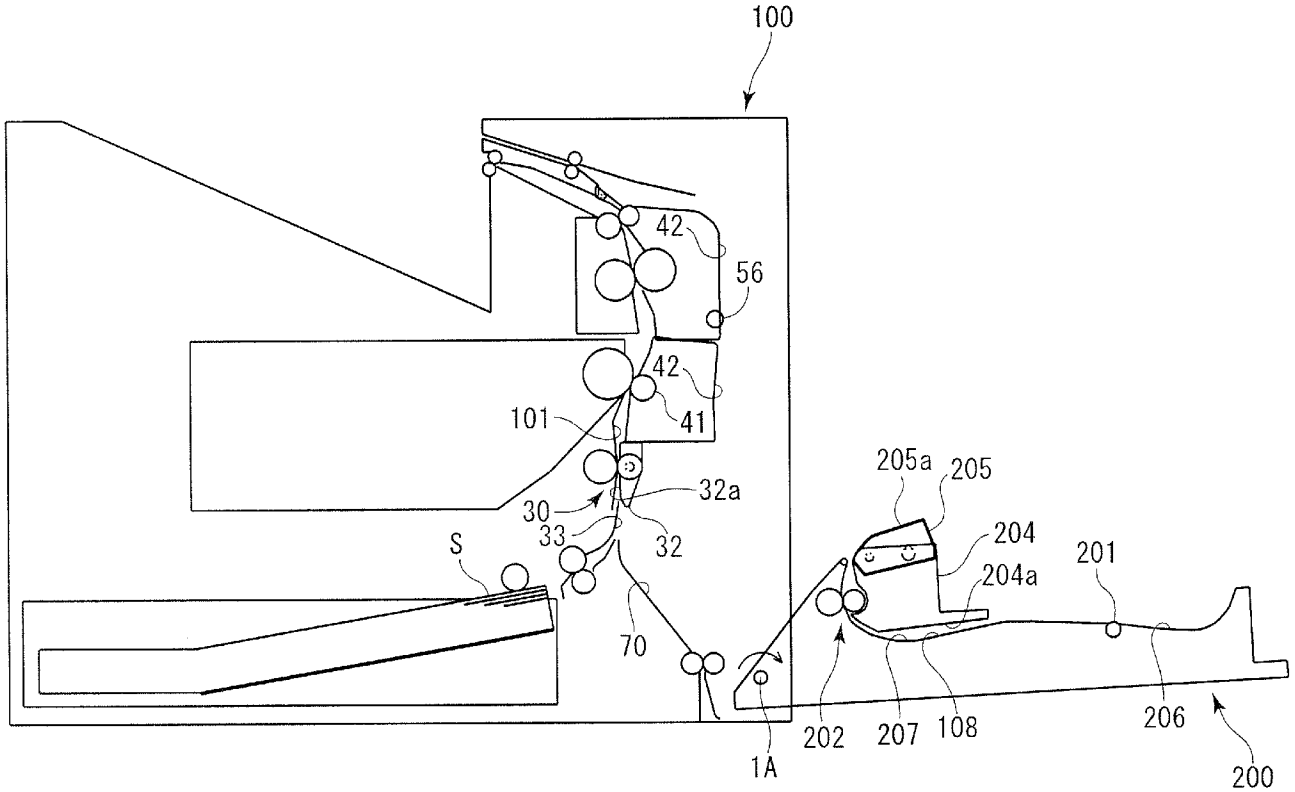
FIG. 2 is a cross-sectional view of the overall configuration, illustrating an open state of the door.

In the present embodiment, when the sheet S is jammed in the printer 1 during the conveyance, the jam can be cleared by opening one portion of the printer 1. In the following description, configurations for ensuring such operation will be described. As illustrated in FIGS. 1B and 2, the printer 1 includes a body portion 100 in which the sheet feeding apparatus 20 is disposed, and a door 200 which serves as an openable portion and is supported by the body portion 100 such that the door 200 can be opened and closed. The door 200 swings on the door swing shaft 1A.

In the body portion 100, components such as the registration roller pair 30, the main path 101, the duplex inner roller 56, the duplex inner guide surface 42, and the joining inner guide surface 70 are disposed. Also in the body portion 100, a downstream passing guide 32, which includes the downstream passing-guide surface 32*a* and serves as a guide member, is fixed with respect to the upper feeding-guide surface 33. The door swing shaft 1A is disposed near the bottom of the body portion 100, and is substantially parallel with the main path 101 and substantially perpendicular to the conveyance direction of the sheet S in the main path 101. Here, the phrase "substantially perpendicular" means that, for example, an angle formed by the conveyance direction of the sheet S and the door swing shaft 1A may not necessarily be 90 degrees, and may be 85 to 95 degrees. The same holds true for the expression of "substantially perpendicular" in the following description made for the other portions.

In the door 200, the duplex outer guide surface 206, the outer guide surface 207, the duplex outer roller 201, and the refeeding roller pair 202 are disposed. Also in the door 200, an inner guide 204 and an upstream passing guide 205 are provided. The inner guide 204 includes an inner guide surface 204*a* and serves as a first movable guide (movable portion). The upstream passing guide 205 includes the upstream passing-guide surface 205*a* and serves as a second movable guide (movable portion).

When the door 200 is closed, a locking portion (not illustrated) disposed near the upper edge of the door 200 and a locked portion (not illustrated) of the body portion 100 engage with each other, and the door 200 is locked to the body portion 100. The door 200 includes an operation portion (not illustrated), with which an operator unlocks the door 200 from the body portion 100. In addition, when the door 200 is closed, the door 200 is locked to the body portion 100 by the locking portion engaging with the locked portion, and the duplex inner guide surface 42 and the duplex outer guide surface 206 come closer to each other to form the duplex conveyance path 102. Furthermore, the upstream passing-guide surface 205*a* and the joining inner guide surface 70 come closer to each other to form the joining path 105, and the upstream passing-guide surface 205*a* and the upper feeding-guide surface 33 come closer to each other to form the upstream passing path 106. This formation produces a state where the sheet S can be conveyed through the duplex conveyance path 102 and the curved path 120.

The door 200 includes side plates (not illustrated) on both sides of the door 200. On the side plates, the inner guide 204 is supported such that the inner guide 204 can pivot, or move, on a first shaft 1B provided in substantially parallel with the door swing shaft 1A. The inner guide 204 includes a first stopper portion 204*b*. The first stopper portion 204*b* comes to abut against the door 200 when the inner guide 204 pivots in a direction X illustrated in FIG. 1B, which is a first pivoting direction. The first stopper portion 204*b* may be formed near the first shaft 1B. The upstream passing guide 205 is supported on the inner guide 204 such that the upstream passing guide 205 can pivot, or move on a second shaft 1C. The second shaft 1C is disposed nearer to the door swing shaft 1A than the first shaft 1B, and substantially parallel with the first shaft 1B. The upstream passing guide 205 includes a second stopper portion (not illustrated). The second stopper portion comes to abut against the inner guide 204 when the upstream passing guide 205 pivots, by a predetermined angle, in a direction Y, which is a second pivoting direction and opposite to the direction X illustrated in FIG. 1B. The second stopper portion abuts against the inner guide 204 when the door 200 is opened, and does not abut against the inner guide 204 when the door 200 is closed.

In addition, a torsion coil spring 209 is provided between the door 200 and the upstream passing guide 205. The torsion coil spring 209 is formed of a single spring wire, and serves as an urging portion. The torsion coil spring 209 includes a coil portion 209*c* formed helically around the first shaft 1B, a fixed end 209*b* formed at one end of the coil portion 209*c*, and an urging end 209*a*, or a free end, formed at the other end of the coil portion 209*c*. The fixed end 209*b* and the urging end 209*a* extend linearly in directions substantially perpendicular to the axial direction of the coil portion 209*c*.

The fixed end 209*b* is fixed on the side plates of the door 200. The urging end 209*a* is in contact with a contact portion 205*b* of the upstream passing guide 205, and urges the upstream passing guide 205 so as to pivot in the direction Y. The contact portion 205*b* is disposed in a position more separated from the door swing shaft 1A than the second shaft 1C. With this configuration, when the door 200 is closed, the upstream passing guide 205 is pressed against the downstream passing guide 32, with the second shaft 1C serving as an axis of the pivot, by the force applied by the urging end 209*a* in the direction Y. That is, an abutment surface 205*c* formed in an upper portion of the upstream passing guide 205 abuts against the downstream passing guide 32, which is formed in the body portion 100 and serves as an abutment portion. Thus, the upstream passing guide 205 is restricted from moving in a thickness direction of the sheet which is passing through the downstream passing path 107, that is, a left direction in FIG. 1B.

In this state, the urging end 209*a* of the torsion coil spring 209 pushes the upstream passing guide 205 in the left direction in FIG. 1B. As a result, the upstream passing guide 205, which is joined with the inner guide 204 via the second shaft 1C, pivots on the first shaft 1B in the clockwise direction X illustrated in FIG. 1B. In other words, the urging force of the urging end 209*a* causes the upstream passing guide 205 to produce the moment at the second shaft 1C, acting in the direction X and around a contact point at which the upstream passing guide 205 is in contact with an upstream portion of the downstream passing guide 32. The moment also acts on the inner guide 204, around the first shaft 1B. With this action, the first stopper portion 204*b* of the inner guide 204 is pressed against the door 200 by a second urging force which is of the moment acting in the direction X, and thus positions of the inner guide 204 and the upstream passing guide 205 are fixed.

In FIG. 2, the door 200 is tilted by a substantially 90 degrees, from a close state in which the door 200 is closed to the body portion 100. In this open state, the sheet S is not conveyed through the duplex conveyance path 102 and the curved path 120. Here, the phrase "substantially 90 degrees" means that an angle formed by the door 200 in the close state and the door 200 in the open state may not necessarily be 90 degrees, and may be 80 to 100 degrees, for example.

In the open state of the door 200, the duplex inner guide surface 42 and the duplex outer guide surface 206 are separated from each other and the duplex conveyance path 102 is opened. In addition, in the open state of the door 200, the upstream passing-guide surface 205*a* is separated from the joining inner guide surface 70 and the upper feeding-guide surface 33; and the joining path 105 and the upstream passing path 106 are opened.

Also in the open state of the door 200, the upstream passing guide 205 is urged by the urging end 209*a* in the direction Y, as in the close state of the door 200. In this state, a deflection angle of the torsion coil spring 209 is smaller than that of the torsion coil spring 209 in the close state of the door 200, and the second stopper portion of the upstream passing guide 205 abuts against the inner guide 204. As a result, the inner guide 204 is pressed against the door 200 by a first urging force of the torsion coil spring 209, smaller than the second urging force applied in the close state of the door 200.

Figure 3:
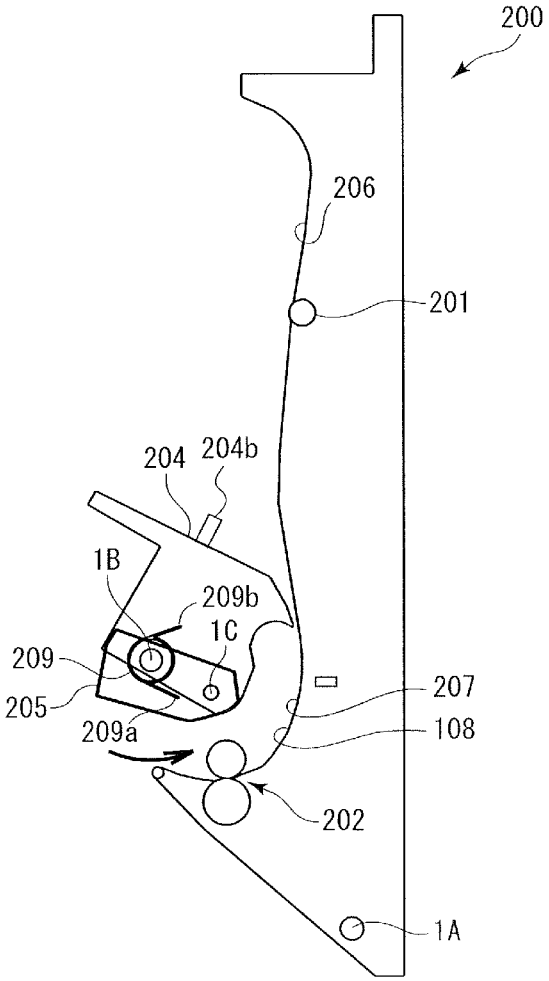
FIG. 3 is a cross-sectional view of the door, illustrating a state where an inner guide is pivoted.

Next, an operation of the inner guide 204 in the open state of the door 200 will be described with reference to FIG. 3. When the inner guide 204 pivots together with the upstream passing guide 205 against the urging force of the torsion coil spring 209, the inner guide surface 204*a* and the outer guide surface 207 are separated from each other, and the inner guide 204 is positioned in a second position at which the first path 108 is opened. The inner guide 204 is provided such that the inner guide 204 can pivot by an angle up to a predetermined angle which is at least 80 degrees.

In addition, the inner guide 204 is provided such that the inner guide 204 can pivot from a first position to the second position, without an operator touching the body portion 100, in a state where the door 200 is opened by at least 80 degrees. When the inner guide 204 is positioned in the second position, and when an external force acting on the inner guide 204 in a pivoting direction of the inner guide 204 is removed (for example, when an operator moves its hand off), the inner guide 204 returns to the first position due to the urging force of the torsion coil spring 209.

As described above, since the printer 1 is provided with the door 200 so that the duplex conveyance path 102, the first path 108, the joining path 105, and the upstream passing path 106 can be opened, a jam of the sheet S can be easily cleared. Specifically, when the jam of the sheet S occurs in the duplex conveyance path 102 or the upstream passing path 106, the jammed sheet S can be easily removed by opening the door 200 to open the duplex conveyance path 102 and the upstream passing path 106.

Also, for example, when the jam of the sheet S occurs in the first path 108, the jammed sheet S can be easily removed by pivoting the inner guide 204 in the open state of the door 200, and positioning the inner guide 204 in the second position to open the first path 108. As can be seen, because less portions are opened when the jam of the sheet S occurs, the jam can be easily cleared by removing the jammed sheet S.

The first path 108 can be opened, without an operator touching the body portion 100, by pivoting the inner guide 204 together with the upstream passing guide 205 from the first position to the second position in a space between the door 200 and the body portion 100. This configuration eliminates the need of securing separate spaces used to open the inner guide 204 and the upstream passing guide 205, and thus can achieve downsizing of the printer 1.

In FIG. 1A, in the close state of the door 200, the upstream passing guide 205 is positioned, pressed against the downstream passing guide 32 by the urging force of the torsion coil spring 209. With this configuration, high positional accuracy of the upstream passing guide 205 with respect to the downstream passing guide 32 can be ensured, and thus the cumulative tolerance of components will be reduced. In other words, even when the position of the openable portion (door 200) in a close state changes due to tolerance or other factor, the second movable guide (upstream passing guide 205) abuts against the abutment portion (downstream passing guide 32) in the apparatus body such that the second movable guide (upstream passing guide 205) moves relative to the first movable guide (inner guide 204) to cancel the change in position, so that the second movable guide (upstream passing guide 205) is positioned at the designated place. This can ensure high accuracy of the dimension of the upstream passing path 106 in the thickness direction of the sheet S, by appropriately controlling dimensional accuracy of the downstream passing guide 32 and positional accuracy of the downstream passing guide 32 to the upper feeding-guide surface 33. In addition, since high accuracy can also be ensured on the position of the downstream passing-guide surface 32*a* to the upstream passing-guide surface 205*a*, these advantages can effectively prevent the jam of the sheet.

In the open state of the door 200, the deflection angle of the torsion coil spring 209 is smaller than that in the close state of the door 200. That is, when the door 200 is opened, the inner guide 204 is urged toward the door 200 by the urging force less than that in the close state of the door 200. As a result, an operator can turn the inner guide 204 with relatively weak force, in the open state of the door 200. In the close state of the door 200, the inner guide 204 can be retained in the first position by the sufficiently strong urging force, without the inner guide 204 opening the first path 108 due to force received by the inner guide 204 during the conveyance of the sheet S.

Because the single torsion coil spring 209 urges the upstream passing guide 205 and the inner guide 204, the number of components can be reduced.

In the present embodiment, the single torsion coil spring 209 urges the upstream passing guide 205 and the inner guide 204, but the torsion coil spring 209 may be two or more. In this case, unevenness of the urging force in the direction of the first shaft 1B can be reduced. In another case, one torsion coil spring 209 may be provided to urge the upstream passing guide 205, and another torsion coil spring 209 may be provided to urge the inner guide 204. In this case, there can be increased flexibility for setting urging forces of them. The form of the torsion coil spring 209 is not limited to the present embodiment. The torsion coil spring 209 may be replaced by a double torsion spring, a compression coil spring, or an elastic component such as a rubber component other than the metallic springs. Instead of the spring, an elastic piece may be integrally formed in the door 200 or with the upstream passing guide 205. Even in a case where any of these resilient members is used, the elastic member can reduce possibility in which the positional variation of the openable portion, caused by tolerance or the like, affects positioning accuracy of the two movable guide, as long as the resilient member deforms when the openable portion is closed, and allows the movable guides to move relative to each other.

The upstream passing guide 205 may abut against the upper feeding-guide surface 33. In this case, there can be ensured high dimensional accuracy of the joining path 105 and the upstream passing path 106 in the thickness direction of the sheet S, regardless of the dimension and the position of the downstream passing guide 32. This can effectively prevent the jam of the sheet. In addition, instead of the configuration in which the abutment portion is integrally formed with a guide such as the downstream passing guide 32, the upstream passing guide 205 may abut against a frame member of the body portion for positioning.

Second Embodiment

Figure 4:
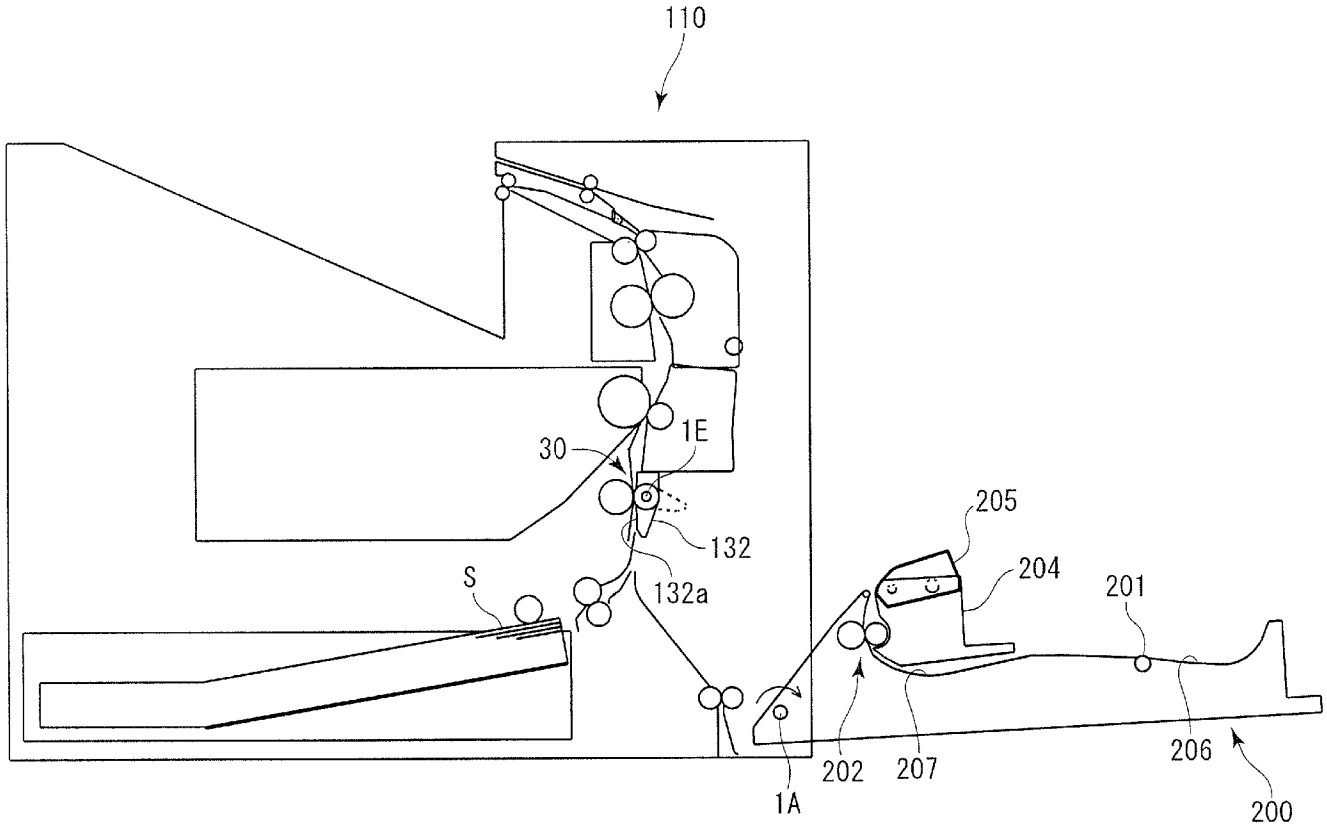
FIG. 4 is a cross-sectional view schematically illustrating an open state of a door of an image forming apparatus of a second embodiment.

Next, a second embodiment of the present disclosure will be described. As illustrated in FIG. 4, the second embodiment employs a downstream passing guide 132 as another example of an abutment portion, which is a swinging member. The downstream passing guide 132 corresponds to the downstream passing guide 32 in the first embodiment. In the following description, the same components as those of the first embodiment are omitted, or given the same symbols in the figure.

In the body portion 110, the registration roller pair 30, the main path 101, the duplex inner roller 56, the duplex inner guide surface 42, and the joining inner guide surface 70 are disposed. Also in the body portion 110, the downstream passing guide 132, which includes the downstream passing-guide surface 32*a* and serves as a guide member, is provided.

The downstream passing guide 132 is supported such that, in the open state of the door 200, the downstream passing guide 132 can swing on a swing shaft 1E with respect to the upper feeding-guide surface 33. The swing shaft 1E is substantially parallel with the door swing shaft 1A and provided in an upper portion of the downstream passing guide 132. The swing of the downstream passing guide 132 can change the position of the downstream passing guide 132 to a position at which the downstream passing guide 132 and the upper feeding-guide surface 33 form the downstream passing path 107, or a position at which the downstream passing guide 132 opens the downstream passing path 107.

The downstream passing guide 132 includes a guide contact portion (not illustrated). The guide contact portion abuts against a body stopper portion (not illustrated) of the body portion 110 when a lower end of the downstream passing guide 132 tilts in a tilting direction in which the lower end approaches the upper feeding-guide surface 33. The guide contact portion is formed outside the edges of the sheet S, which is being conveyed, in the direction of the door swing shaft 1A. In addition, the downstream passing guide 132 is urged by a body urging member (not illustrated) toward the tilting direction, in which the lower end of the downstream passing guide 132 approaches the upper feeding-guide surface 33. The guide contact portion of the downstream passing guide 132 is pressed against the body stopper portion by the urging force of the body urging member, so that the downstream passing guide 132 is fixed in position. The downstream passing guide 132 includes a handing portion 132*a*. In the open state of the door 200, with the handing portion 132*a*, an operator rests his/her fingers on the handling portion 132*a*, and can tilt the downstream passing guide 132 against the urging force of the body urging member.

As described above, because the swingable downstream passing guide 132 allows the downstream passing path 107 to be opened, the jam of the sheet S can be easily cleared. Specifically, when the jam of the sheet S occurs in the downstream passing path 107, the jammed sheet S can be easily removed by opening the door 200 and tilting the downstream passing guide 132 to open the downstream passing path 107.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-217017, filed on Nov. 7, 2016, which is hereby incorporated by reference wherein in its entirety.

What is claimed is:

1. A sheet conveyance apparatus comprising:

a body portion;

an openable unit comprising:

an openable portion supported by the body portion and configured to be opened and closed with respect to the body portion;

a first movable guide configured to guide a sheet;

a first shaft provided on the openable portion and supporting the first movable guide such that the first movable guide pivots with respect to the openable portion on the first shaft, the first movable guide being movable with respect to the openable portion between a first position, at which a first conveyance path through which the sheet is conveyed is formed between the first movable guide and the openable portion, and a second position, at which the first conveyance path is opened, the first shaft being moved away from the body portion along with an opening operation of the openable portion;

a second movable guide movably supported by the first movable guide;

an abutment portion provided in the body portion and configured to abut with the second movable guide in a state where the openable portion is closed, such that the second movable guide is held on a position to form a second conveyance path through which the sheet is conveyed; and an urging portion configured to urge the second movable guide toward the abutment portion in a state where the openable portion is closed, wherein the openable portion is configured to pivot on a second shaft provided on the body portion, the second shaft being parallel with the first shaft, wherein when viewed in an axial direction of the second shaft, the first shaft is moved around the second shaft along with a pivoting operation of the openable portion, wherein the second movable guide is configured to pivot on a third shaft with respect to the first movable guide, the third shaft being parallel with the first shaft, and wherein the urging portion is configured such that, in a state where the openable portion is closed, the urging portion urges the first movable guide in a first pivoting direction around the first shaft and urges the second movable guide in a second pivoting direction around the third shaft, the second pivoting direction being opposite to the first pivoting direction.

2. The sheet conveyance apparatus according to claim 1, wherein the urging portion is configured to urge the first movable guide toward the first position.

3. The sheet conveyance apparatus according to claim 1, wherein the urging portion is disposed between the second movable guide and the openable portion, and is configured to hold the first movable guide on the first position by urging the second movable guide in a state where the openable portion is closed.

4. The sheet conveyance apparatus according to claim 1, wherein the openable portion comprises a contact portion configured to be in contact with the first movable guide in a state where the first movable guide is at the first position, and wherein the urging portion is configured to urge the first movable guide toward the contact portion with a first urging force in a state where the openable portion is opened, and to urge the first movable guide to the contact portion with a second urging force greater than the first urging force in a state where the openable portion is closed.

5. The sheet conveyance apparatus according to claim 1, wherein the urging portion is a torsion coil spring disposed around the first shaft.

6. The sheet conveyance apparatus according to claim 1, wherein the urging portion is a resilient member, and the resilient member is configured to be deformed upon closing the openable portion such that the second movable guide abutting with the abutment portion is moved with respect to the first movable guide along with a deformation of the resilient member.

7. The sheet conveyance apparatus according to claim 1, wherein in a state where the openable portion is closed, the second conveyance path is connected to a downstream end of the first conveyance path in a sheet conveyance direction in the first conveyance path, and wherein the first conveyance path and the second conveyance path form a conveyance path that is curved as viewed from a sheet width direction perpendicular to the sheet conveyance direction.

8. The sheet conveyance apparatus according to claim 7, wherein a guide surface formed by the first movable guide and the second movable guide is located on an inside of the conveyance path that is curved as viewed from the sheet width direction.

9. The sheet conveyance apparatus according to claim 1, further comprising a guide member provided in the body portion such that the second conveyance path is formed between a guide surface of the guide member and the second movable guide in a state where the openable portion is closed, wherein the abutment portion is provided on the guide member and disposed on an opposite side from the guide surface.

10. The sheet conveyance apparatus according to claim 9, wherein in a state where the openable portion is closed, a guide surface of the second movable guide and the guide surface of the guide member are adjacent to each other in a sheet conveyance direction in the second conveyance path, and the second movable guide and the guide member are configured such that, the second movable guide is restricted from moving with respect to the guide member in a sheet thickness direction in the second conveyance path by the second movable guide being abutted with the abutment portion.

11. The sheet conveyance apparatus according to claim 9, further comprising an opposing guide portion provided in the body portion and configured to be opposed to the guide member and the second movable guide in a state where the openable portion is closed, wherein the second conveyance path is formed between the opposing guide portion and both the guide member and the second movable guide.

12. The sheet conveyance apparatus according to claim 9, wherein the guide member is fixed to the body portion.

13. The sheet conveyance apparatus according to claim 9, wherein the guide member is pivotally supported on the body portion such that the second conveyance path can be at least partially opened.

14. An image forming apparatus comprising:

a sheet conveyance apparatus according to claim 1; and an image forming portion configured to form an image on a sheet conveyed by the sheet conveyance apparatus.

15. The image forming apparatus according to claim 14, wherein the first conveyance path and the second conveyance path form a curved path connecting a main path and a reconveyance path, the main path being configured to guide a sheet to the image forming portion, the reconveyance path being provided in parallel with the main path and configured to guide a sheet on which an image is formed by the image forming portion and which is turned over by a switchback conveyance.

* * * * *